United States Patent [19]

Mitani et al.

[11] Patent Number: 4,606,675

[45] Date of Patent: Aug. 19, 1986

[54] METHOD OF AND APPARATUS FOR SOIL STABILIZATION

[75] Inventors: Takeshi Mitani, Shizuoka; Hideo Aiko, Kobe, both of Japan

[73] Assignee: Kabushiki Kaisha Kobe Seiko Sho, Kobe, Japan

[21] Appl. No.: 691,885

[22] Filed: Jan. 16, 1985

[30] Foreign Application Priority Data

Feb. 2, 1984 [JP] Japan ..... 59-16132

[51] Int. Cl.[4] ..... E02D 3/12

[52] U.S. Cl. ..... 405/263; 405/267; 405/269

[58] Field of Search ..... 405/263, 269, 267, 266, 405/240, 241, 242; 166/50, 285, 292; 106/900, 95

[56] References Cited

U.S. PATENT DOCUMENTS

| | | | |
|---|---|---|---|
| 416,180 | 12/1889 | Neukirch | 405/266 |
| 1,889,599 | 11/1932 | Goldsborough | 405/266 |
| 1,952,162 | 3/1934 | Gee et al. | 405/266 |
| 2,782,605 | 2/1957 | Wertz et al. | 405/266 |
| 3,023,585 | 3/1962 | Liver | 405/266 |
| 3,180,098 | 4/1965 | Spencer | 405/263 |
| 3,875,751 | 4/1975 | Paus | 405/263 |
| 4,133,179 | 1/1979 | Kawaski et al. | 405/263 |
| 4,316,679 | 2/1982 | Lundmark et al. | 405/263 X |

FOREIGN PATENT DOCUMENTS 0148820 11/1980 Japan ..... 405/263

*Primary Examiner*—Dennis L. Taylor

*Attorney, Agent, or Firm*—Oblon, Fisher, Spivak, McClelland & Maier

[57] ABSTRACT

Soft soil stratum is stabilized by jetting powdery agent into the ground and mixing and agitating the same with the soil, wherein a rotary shaft is inserted into the ground and a powdery stabilized agent carried by air is pneumatically transported by way of a transportation tube positioned within the rotary shaft and is jetted out from a nozzle disposed in communication with a blade which is integrally attached to and extended from the bottom end of the shaft, is mixed and is agitated for solidification with the soil by the rotation of the mixing blade, while the carrier air jetted into the ground is induced and discharged to the outside of the ground after separation and filtration. The state of the supply of the powdery stabilized agent is continuously optimally controlled in accordance with a predetermined set condition. The powdery stabilized agent can be transported smoothly and mixed with the soil uniformly to provide satisfactory soil stabilization, without repair and maintenance problems.

11 Claims, 35 Drawing Figures

METHOD OF AND APPARATUS FOR SOIL STABILIZATION

BACKGROUND OF THE INVENTION

1. Field of the Invention

This invention concerns an improvement of the soft soil stratum and, more specifically, relates to soil stabilization by supplying cement or other powdery stabilizing agent into the ground by jet injection method and mixing and agitating the same with the soil for chemical solidification in-situ.

2. Description of the Prior Art

As is well-known, soil stabilization for the soft soil stratum has generally been performed by the injection of chemical grouting. However, injection of chemical grouting has drawbacks in that the chemicals contaminate underground water so as to bring about public pollution, control for the chemical reaction is difficult, and the choice of the chemicals is restricted.

In view of the above, new soil stabilization by supplying a powdery stabilizing agent such as cement, quick lime or slug into the soft ground, mixing and agitating the same with the underground soil for solidification in-situ chemically has recently been developed.

However, in the case where the powdery stabilizing agent has to be introduced deep within the ground, a difficulty in transporting the powdery stabilizing agent from above the ground to the intended underground level may arise. There has been developed a technique involving supplying the powdery stabilizing agent under pressure through a transportation channel pipe disposed along the outer surface of a rotary shaft. However, if the powdery stabilizing agent is transported to an extremely great depth, clogging may be caused by the powdery stabilizing agent in the transportation channel pipe failing to obtain a sufficient power supply under pressure. Furthermore, it is impossible to measure and control the amount of the powdery stabilizing agent jetted into the soft soil stratum thus making it difficult to perform satisfactory soil stabilization.

SUMMARY OF THE INVENTION

Accordingly, it is an object of this invention to provide a method of improving the soft soil stratum capable of overcoming the problems in the prior art of supplying the powdery stabilizing agent into the soft ground and mixing and agitating the same with the soil for chemical solidification in-situ.

Another and specific object of this invention is to provide a method of improving the soft soil stratum by smoothly supplying the powdery stabilizing agent by means of pneumatic transportation from above to the ground, uniformly mixing and agitating it with the underground soil for solidification in-situ chemically while preventing the escape of the residual powdery stabilizing agent from the ground which may cause public pollution.

A further object of this invention is to provide a method of improving the soft soil stratum by jetting out the powdery stabilizing agent from above to the ground and mixing and agitating the same with the underground soil for chemical solidification in-situ while controlling the amount of the powdery stabilizing agent jetted out underground to thereby attain uniform and satisfactory improvement of the ground.

A still further object of this invention is to provide an apparatus capable of practicing the method of improving the soft soil stratum by pneumatically supplying and jetting out the powdery stabilizing agent to the ground and mixing and agitating the same with the underground soil for chemical solidification in-situ.

The foregoing objects can be attained by the method according to this invention of improving the soft soil stratum by transporting the jetting out powdery stabilizing agent to the ground and mixing and agitating the same with the underground soil for chemical solidification in-situ, in which the powdery stabilizing agent carried in air is supplied pneumatically under pressure through a transportation tube disposed inside a rotary shaft inserted into the ground to be improved, the powdery stabilizing agent and the compressed air are jetted out from a nozzle disposed to an mixing blade extended integrally from the base end of the rotary shaft and mixed and agitated with the soil for chemical solidification by the mixing blade, while the supply is constantly controlled in accordance with a set condition, and the carrier air being jetted into the ground is guided into and discharged from the ground after separation and filtration.

The foregoing method of this invention can be carried out by an apparatus for improving the ground by pneumatically supplying and jetting the powdery stabilizing agent into the ground and mixing and agitating the same with the underground soil for chemical solidification in-situ, comprising a powder supply device equipped with a constant volume discharge mechanism, a rotary shaft formed with an inside transportation tube which is connected by means of a swivel joint to the constant volume discharging mechanism, a mixing blade disposed at the top end of the rotary shaft, a nozzle formed at the end of the transportation tube and opened to the mixing blade, and an exhaust guide connected to the rotary shaft in communication with the surface of the ground for discharging the carrier air, the constant volume discharge mechanism and the elevating device for the rotary shaft being connected with a control device.

The specific method of this invention comprises inserting an rotary shaft equipped with an mixing blade at the base end thereof to the inside of the soft soil stratum, pneumatically transporting the cement or other powdery stabilizing agent carried in air through the interior of the rotary shaft, jetting out the pneumatically transported powdery stabilizing agent from the nozzle disposed to the base end of the rotary shaft into the ground, mixing and agitating the powder with the soil for uniform solidification, while inducing the air used for the transportation through the exhaust guide at the side of the rotary shaft to outside the ground, separating from the powdery stabilizing agent and then discharging the same into the atmosphere.

BRIEF DESCRIPTION OF THE DRAWINGS

These and other objects, features and advantages of this invention will now be described more specifically by way of its preferred embodiments referring to the accompanying drawings, wherein.

BRIEF DESCRIPTION OF THE PREFERRED EMBODIMENTS

Figure 1:
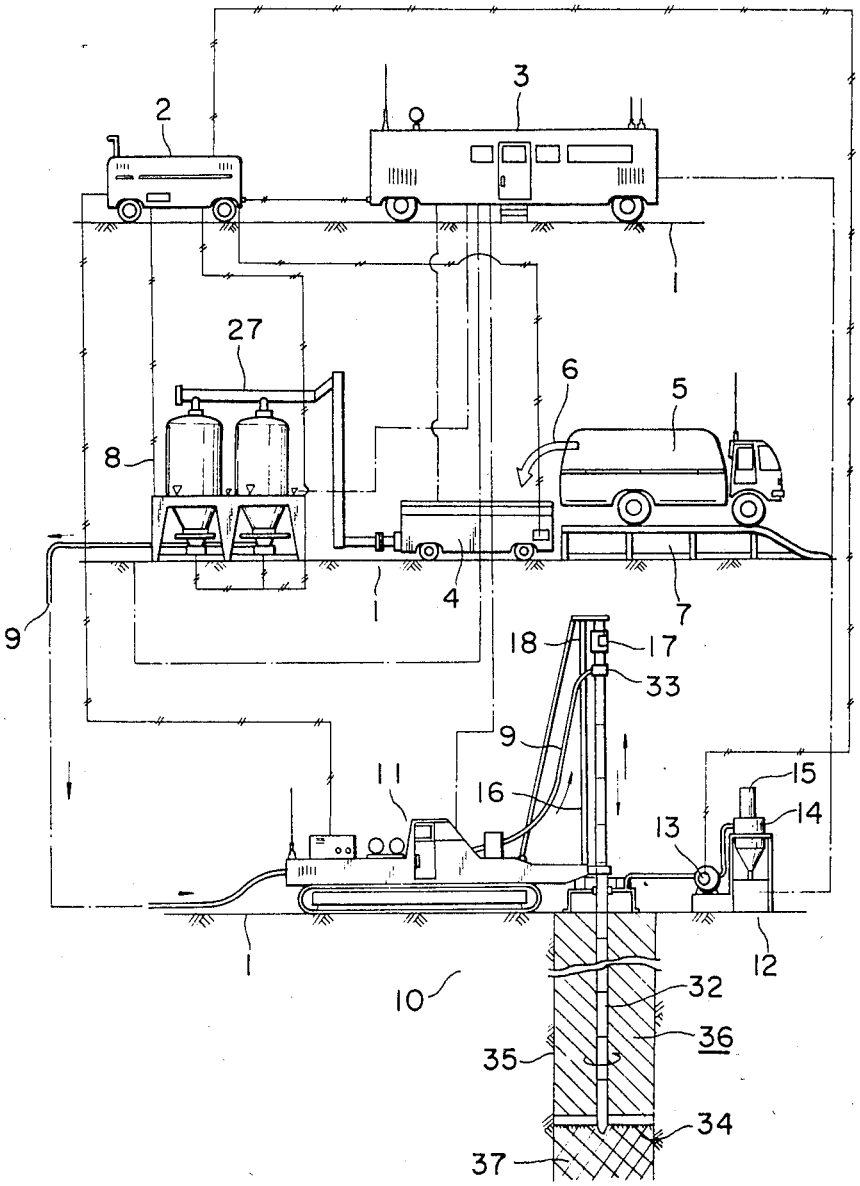
FIG. 1 is a schematic explanatory view of the entire system according to this invention.

The outline for the entire ground improving system to which this invention is applied is to be described by first referring to FIG. 1. In the drawing, the soft soil stratum 1 is shown as three stages separated vertically from each other for the sake of the simplicity of the drawing. It should, however, be noted that the ground surface is actually continuous horizontally from the left (uppermost state) to the right (lowermost stage) in the drawing. In the drawing are shown a movable electric power generator 2, a control vehicle 3 having various types of control device, recording device and instruction device (each not shown) and a hopper 4 of a predetermined capacity. Cement 6 or another powdery stabilizing agent is supplied at an optimal time interval from the tank lorry 5 guided along a step 7 to the hopper 4. The cement 6 may alternatively be fed directly by means of a pipeway connected between a suitable cement delivery source and the hopper.

A powder supply device 8 disposed at the side of the hopper 4 is connected by means of a hose 9 to a base machine 11 accessible to the improved area 10. A powder separation device 12 is disposed at the side of the base machine 11.

A suction pump 13 serving as the powder suction means in the powder separation device 12 is connected to a cyclone 14, over which is further disposed a bag filter 15 as a powder filter means.

The base machine 11 may be a well-known type crawler machine, in which a motor 17 and a pressure-controlled type pinion rack or winch type elevating device 18 is disposed near the support at the upper end of a leader 16.

Figure 2:
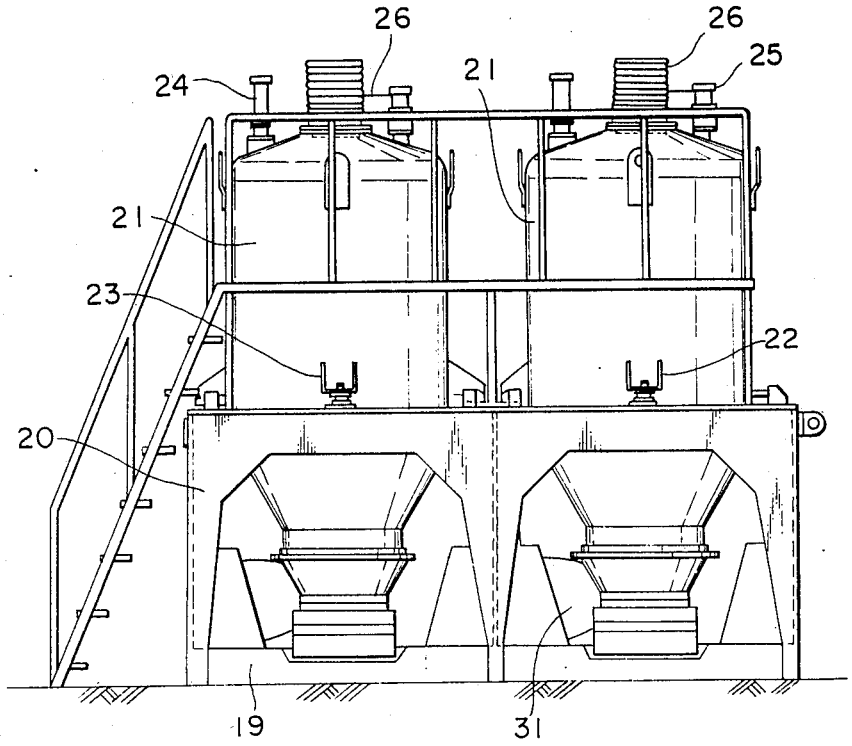
FIG. 2 is a side elevational view, partially in cross section, of a powder supply device for use in this invention.
Figure 3:
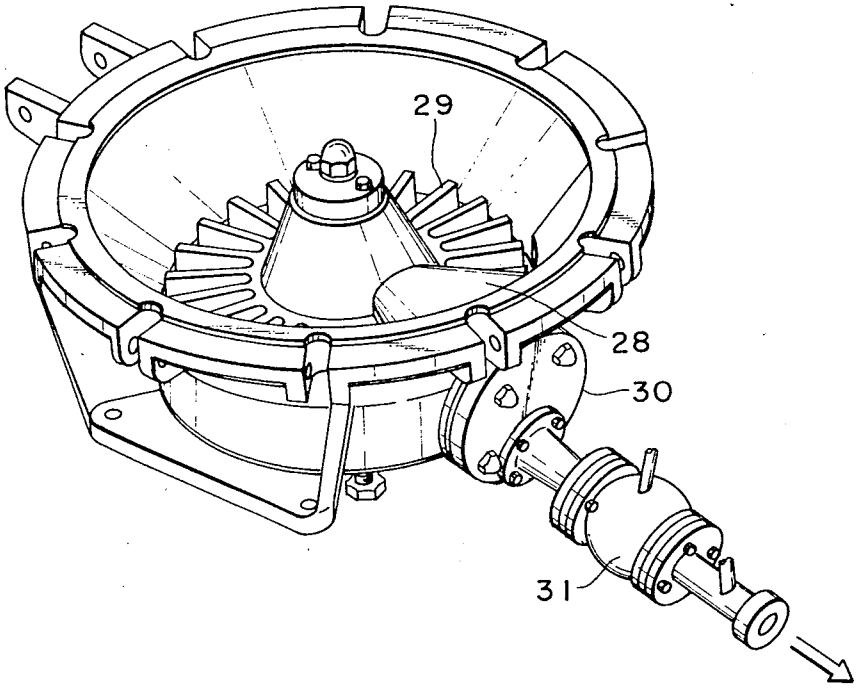
FIG. 3 is a perspective view of a portion of a powder supply device.

Referring more specifically to the powder supply device 8, a set of hoppers 21 are placed each by means of a load cell 23 as a weight reduction detection means to a support bracket 22 which is integrally formed to a stand 20 secured on a base 19 disposed on the surface of the soft ground 1 as shown in FIGS. 1, 2 and 3. At the upper surface of the hopper 21, are disposed actuation cylinders 24, for pressurizing powder charging valves upon closure and an exhaust valve 25 for adjusting the inner pressure of the hopper 21. The hopper 21 is connected at its top by means of an airtight bellows 26 to the hopper 4 so that cement 6 as the powdery stabilizing agent may be supplied by a screw feeder 27 from the hopper 4.

An outlet cover 28 is disposed inside at the lower end of the hopper 21 so as to apply an effective pressure to the cement agent at a predetermined position relative to the rotation of a rotary feeder 29 connected to a motor. On the side of the rotary feeder 29 is disposed an exhaust port 30 for the cement agent, which is connected to the hose 9 by way of a pinch valve 31 for rapidly interrupting the supply of the cement agent upon occurrence of an emergency.

As shown in FIG. 1, a rotary shaft 32 is connected by way of a swivel joint 33 to the hose 9 while being coupled to the motor 17 disposed at the top end of the base machine 11, detachably and in a telescopic manner. A mixing blade 34 is secured at the lowermost end of the rotary shaft 32.

Further, as shown in FIG. 1, the rotary shaft 32 with the mixing blade 34 is adapted to be inserted into a column 35 in the soft ground 1 previously drilled appropriately and is rotated to mix the cement material with soil 36 and solidify the same uniformly with the elapse of time in stabilized soil 37.

Figure 4:
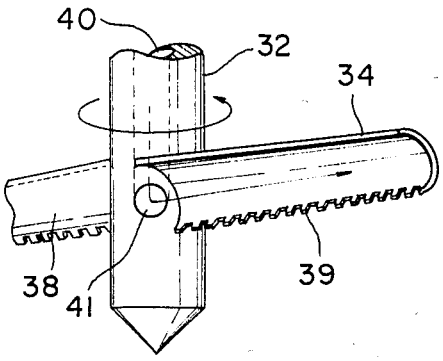
FIG. 4 is a perspective cut-away view of a portion of an mixing blade mounted to its rotary shaft.

Referring then to the rotary shaft 32 and the mixing blade 34 in conjunction with FIG. 4 and so forth, the mixing blade 34 is attached to and extended in the diametrical direction from the top end (lower end) of the rotary shaft 32. The mixing blade 34 has a curved cross section and the shape of the curve is reversed with respect to each side of the rotary shaft 32 so that the mixing blade 34 has a cross sectional profile convexed to the rotating direction of the rotary shaft 32 shown by the arrow in the drawing. A row of small fingers 39, 39 are formed integrally at the lower edge of the blade 34 so that mixing can be effected readily and effectively. A transportation tube 40 is formed coaxially to and located within inside the rotary shaft 32 and opens as a nozzle 41 at the base end of the mixing blade 34, so that powdery cement agent or the like pneumatically transported as described above may be jetted out together with air as the carrier gas along the longitudinal direction of the mixing blade 34 and at the interior thereof as shown by the arrow in the drawing.

As shown in FIG. 4, since the mixing blade 34 has a cross section protruding in the rotational direction thereof, when the rotary shaft 32 rotates in the direction of the arrow, the pneumatically transported powdery cement agent or the like jetted out from the nozzle 41 suffers no effect from the pressure of the soil 36.

In the fundamental constitution of the mixing blade 34 and the rotary shaft 32 illustrated in the drawing, when the rotary shaft 32 is inserted downwardly into the ground 1, only the compressed air as the carrier gas is jetted out from the transportation tube 40 to the nozzle 41 to facilitate the insertion of the mixing blade 34 into the ground. On the other hand, upon extraction of the rotary shaft 32, the pneumatically transported cement agent is jetted out through the transportation tube 40 from the nozzle 41 and uniformly mixed and agitated with the previously pulverized and agitated soil 31 into a mixed layer 37. Then, the cement agent mixed with the soil 36 brings about a solidification reaction with the water content in the soil with the elapse of time to thereby improve the soft soil stratum.

Upon downward insertion and extraction of the rotary shaft 32 into and out of the ground, slight gaps are formed between the rotary shaft 32 and the ground or the soil because the stroking movement of the shaft is not always linear. This advantageously forms a passage for the compressed air into and outside of the ground 1 to facilitate the insertion and the extraction of the rotary shaft 32.

Figure 6:
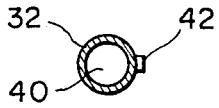
FIG. 6 is a cross sectional view of the rotary shaft shown in FIG. 5.
Figure 5:
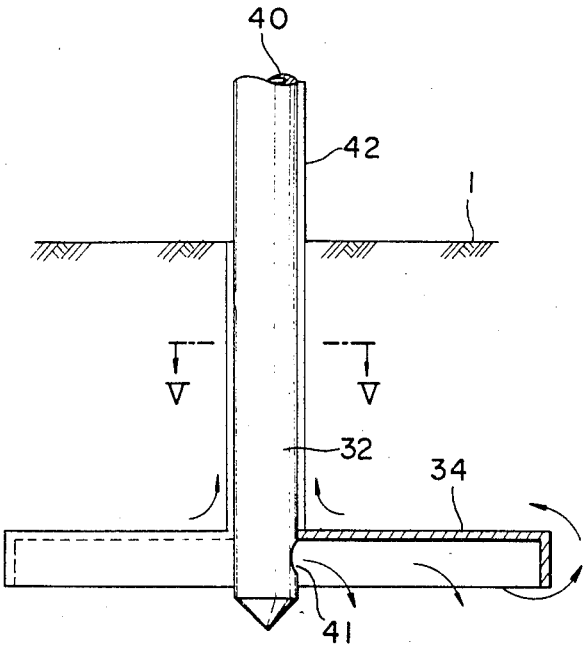
FIG. 5 is a side elevation view partially in cross section of the rotary shaft illustrating the state of jetting out powder and carrier air from the ground.

Although the illustrated rotary shaft 32 has a circular cross section in its fundamental mode, an exhaust guide 42 of a predetermined width and height may be integrally formed with the circumference of the rotary shaft 32 extended as far as the upper surface of the rotary blade 34 as shown in a modified embodiment of FIG. 5 and FIG. 6, so that a hollow portion may be formed in the soil at the back of the exhaust guide 42 upon rotation of the rotary shaft 32 for positively forming the passage of the air as the carrier gas upwardly from the ground.

Figure 7:
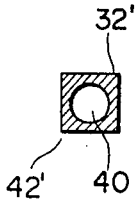
FIG. 7 is a cross sectional view of another embodiment of the rotary shaft.

Alternatively, the rotary shaft may be formed in a square cross section as shown in the embodiment of FIG. 7 so that the corner 42' of the square cross section functions as an exhaust guide 42' to form a hollow portion at the back of the blade upon rotation of the rotary shaft 32, which similarly functions as the discharging passage for the uprising carrier gas or the like.

Figure 8:
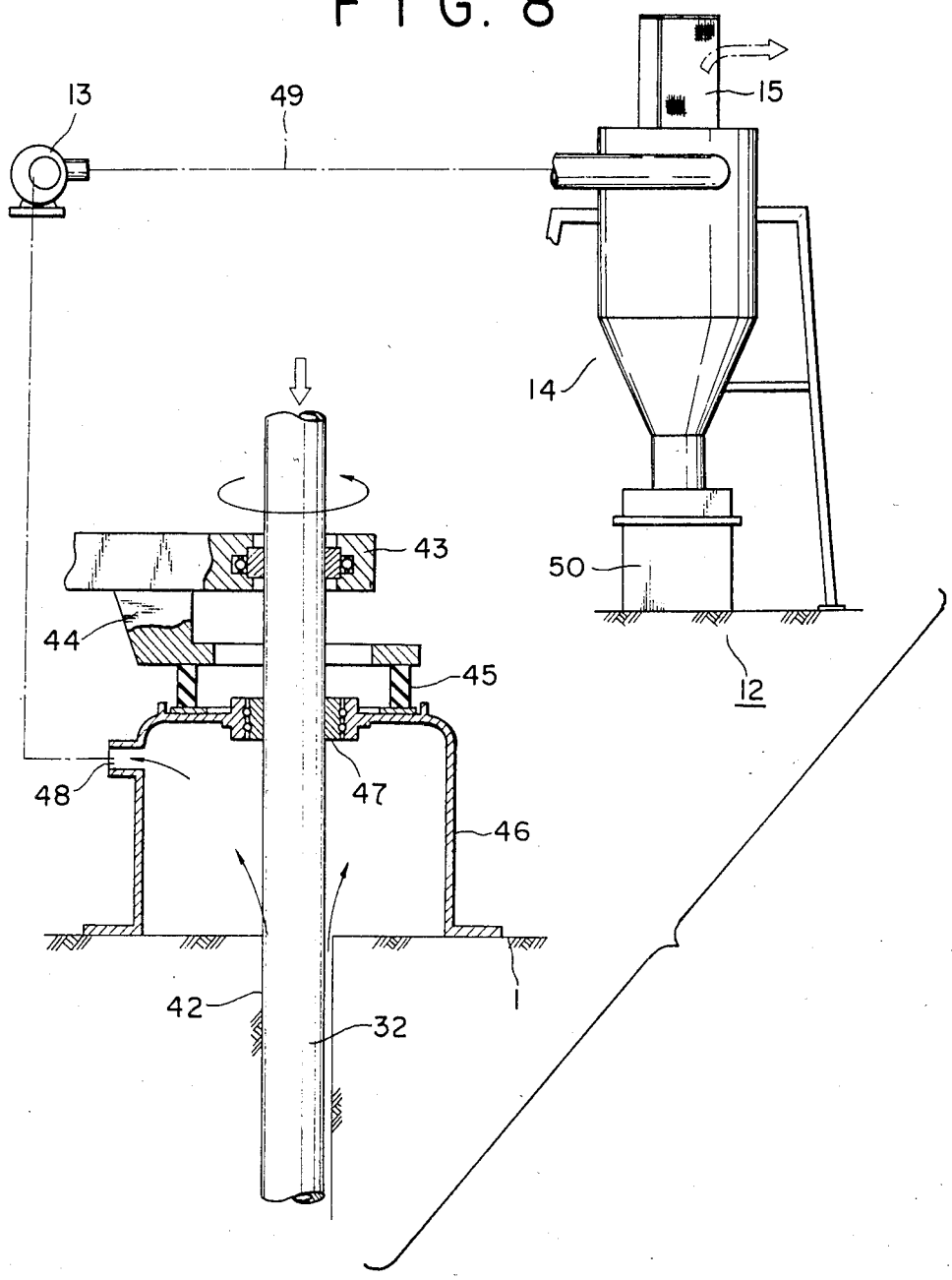
FIG. 8 is a side elevational view, partially in cross section, of the cover of a powder separation device and a cyclone disposed to the powder separation device.

As shown in FIG. 8, the rotary shaft 32 having the guide 42 formed therealong and disposed to the head of the base machine 11 shown in FIG. 1 passes through the hood 46 which is set between a bracket 44 integral with the guide 43 and the ground 1 by way of a ring-like retainer jig 45 made of rubber. The rotary shaft 32 is received as to be vertically movably and rotatably by means of a ball bearing 47. The air as the carrier gas containing a slight amount of cement agent rising through the gap formed at the back of the guide 42 from the ground 1 is discharged into the hood 46, sucked from the exhaust port 48 of the hood 46 to the suction pump 13 and then sent by means of a hose 49 to the cyclone 14 of the powder separation device as described above. Then, the cement agent or the like is separated from the air and collected in the cement box 50 therebelow, while clean air is discharged through the filter disposed above the powder separation device into the atmosphere.

Thus, during extraction of the rotary shaft 32 relative to the initially set hood 46, the carrier gas and/or the cement agent transported by way of the transportation channel 40 are not directly discharged to the atmosphere but discharged after being separated with the powder in the hood 46 and the cyclone 14, whereby there is no danger of contaminating the working environment or circumstantial environment.

Essential factors for soil stabilization by powder jetting and mixing according to this invention comprise the insertion and extraction of the rotary shaft 32 into and out of the ground, countermeasures for the environmental contamination with powder and the mixing and agitation of the powder with the soil 36 in the ground 1. Since the outline of the former two factors have already been explained, admixture and agitation of the powder with the soil 36 will now be described in each of the modes specified hereinbelow.

At first, it should be noted that if the resistance caused by the soil or the like to the rotary shaft 32 and the mixing blade 32 integral therewith varies upon insertion and extraction into and out of the ground 1, the insertion or extraction speed is changed and, accordingly, the supply of the powdery cement is varied depending on the time.

If the amount of supply of the cement agent fluctuates, such changes the density of the powdery cement depending on the height of the soil 36 so as to result in variation in the solidification rate failing to obtain uniform soil stabilization.

In view of the above, in one embodiment according to this invention, an inner pipe 51 is formed within the rotary shaft 32 as an exclusive transportation tube 40 and the pipe is opened as a nozzle 41 at the base of the mixing blade 34. The annular gap 52 formed between the inner pipe 51 and the outer wall of the rotary shaft 32 is used as a passage exclusively for the feeding of compressed air and a predetermined number of gas exhaust holes 53, 53, are perforated and opened to the outer circumference of the rotary shaft 32.

In this embodiment, compressed air can be sent through the annular gap 52 and discharged from the exhaust holes 53, 53, to allow the gas stream to rise through the gap 54 between the rotary shaft 32 and the ground 1, whereby downward insertion and rising extraction of the rotary shaft 32 and the mixing blade 34 can be facilitated and the vertical velocity thereof can be maintained constant as much as possible. Therefore, the supply of carrier air and the cement powder is always kept constant with time and mixing and agitation of cement agent with the soil can be kept uniform, while the separated air can be discharged above the ground together with the uprising air stream from the exhaust holes 53, 53, through the gap 54 thus formed.

Figure 9:
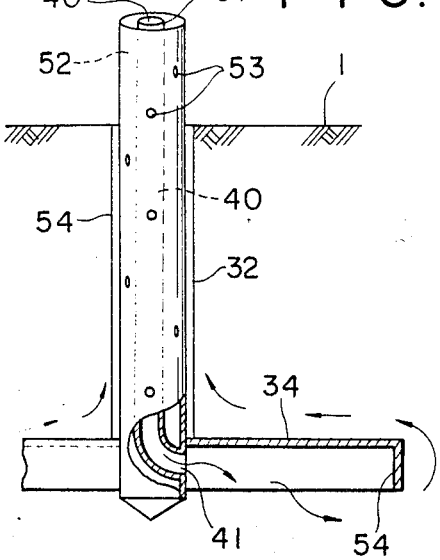
FIG. 9 is a side elevational view, partially in cross section, of another embodiment of the rotary shaft.
Figure 10:
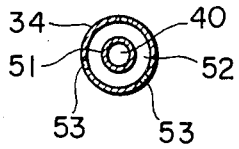
FIG. 10 is a transverse cross sectional view of the rotary shaft shown in FIG. 9.

Further, a bulk head 54 may desirably be disposed at the outer end of the mixing blade 34 as shown in FIG. 9 by which the mixing and agitating area for the pneumatically transported powder with the soil can be definitively confined. Accordingly, in this modified embodiment, the extent of individual areas to be improved and the overlap between them can be predetermined to enable more accurate and effective soil stabilization.

In the case where the distance of the power transportation is larger, for example, where the soil stabilization is carried out in an extremely deep stratum, pressure for pneumatically transporting the cement powder has to be correspondingly increased. In such case, although the pressure for the pneumatic transportation can properly be controlled by the control device 3, for instance, along with the uprising of the rotary shaft 32, since the cement powder is jetted out from the nozzle 41 at the extreme end of the rotary shaft at a high pressure, the powder may be distributed nonuniformly, that is, concentrated more and more toward the bulk head of the mixing blade 34. In such a case, another bulk head 54' may be additionally disposed to the inside of the mixing blade 34 in the longitudinally direction thereof as shown FIG. 11.

Figure 11:
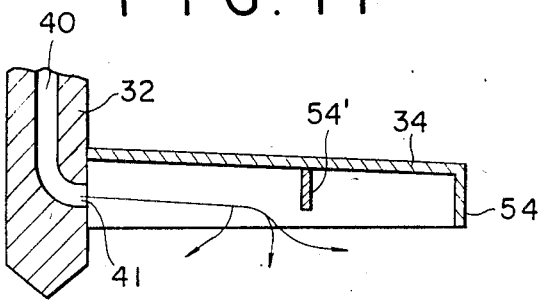
FIG. 11 is a longitudinal cross sectional view of the first embodiment of the mixing blade.
Figure 12:
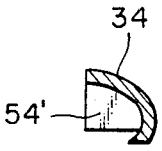
FIG. 12 is a transverse cross sectional view of the mixing blade shown in FIG. 11.
Figure 13:
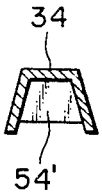
FIG. 13 is a transverse cross sectional view of another embodiment of the mixing blade.

In the embodiment shown in FIG. 11, the cross sectional shape of the mixing blade 34 may be properly modified with respect to the bulk head 54' as illustrated in FIG. 12 or FIG. 13.

Figure 14:
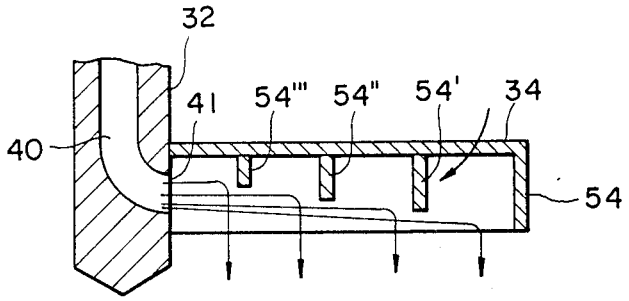
FIG. 14 is a vertical cross sectional view of a further embodiment of the mixing blade.
Figure 15:
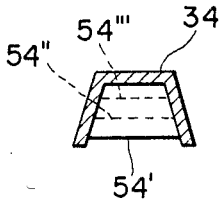
FIG. 15 is a transverse cross sectional view of the mixing blade shown in FIG. 14.
Figure 16:
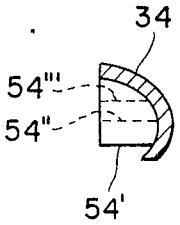
FIG. 16 is a transverse cross sectional view of a further embodiment of the mixing blade corresponding to FIG. 15.

The undesired localized distribution of the cement powder as described above is increased as the size of the mixing blade 34 and the rotary shaft 32 is larger. In this case, a further modified embodiment as shown in FIG. 14 can be employed, in which a plurality of bulk heads 54', 54'', 54''' are utilized with the height of the same being increased gradually along the longitudinal direction of the mixing blade 34 toward the outer end of the blade. The cross sectional shape of the mixing blade 34 may properly be designed also in this case as required with respect to the bulk heads 54', 54'', 54''' as shown in FIG. 15 and FIG. 16.

Figure 17:
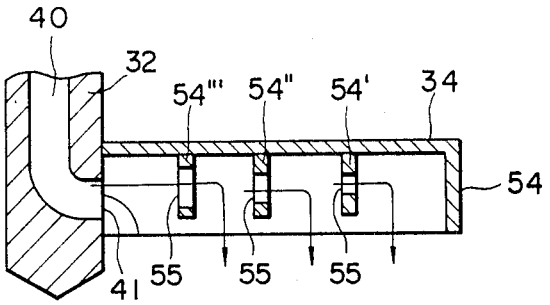
FIG. 17 is a vertical cross sectional view of a further mixing blade corresponding to FIG. 14.

In a further modified embodiment shown in FIG. 17, apertures 55, 55, 55 are formed in each of the bulk heads 54', 54'', 54''' for short passing of the powder stream to thereby make the distribution of the pneumatically transported cement powder more uniform in the rotational region of the mixing blade 34.

Figure 18:
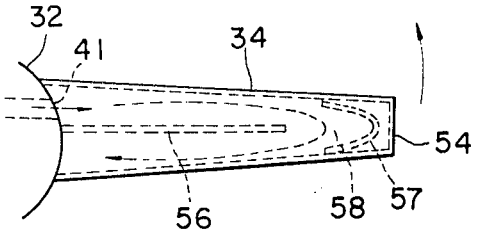
FIG. 18 is a plan view for a part of a still further embodiment of the mixing blade.
Figure 19:
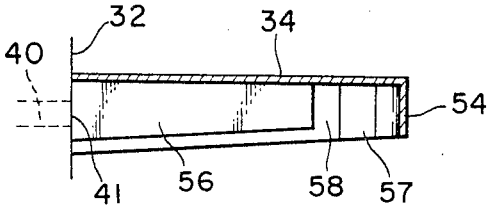
FIG. 19 is a vertical cross sectional view of the mixing blade shown in FIG. 18.
Figure 20:
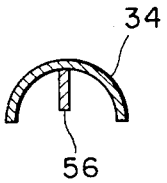
FIG. 20 is a transverse cross sectional view illustrating a profile for the embodiment shown in FIG. 18.
Figure 21:
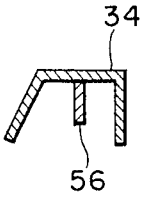
FIG. 21 is a transverse cross sectional view illustrating another profile of the embodiment shown in FIG. 20.
Figure 22:
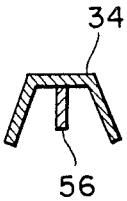
FIG. 22 is a transverse cross sectional view illustrating a further profile of the embodiment shown in FIG. 20.
Figure 23:
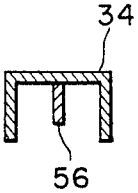
FIG. 23 is a transverse cross sectional view illustrating a still further profile of the embodiment shown in FIG. 20.

In the embodiment shown in FIG. 18 and FIG. 19, the nozzle 41 is not opened at the angle aligned with the diametrical extension of the rotary shaft 32 but is deviated somewhat in advance from the rotational direction of the shaft. Further, a guide plate 56 is disposed at approximately the lateral center (on the diametrical extension) of the mixing blade 34 along the longitudinal direction thereof, and a bent guide 57 is disposed inside the bulk head 54 so as to form a deflected path 58, whereby the cement powder pneumatically transported and jetted out from the nozzle 41 is passed just back of the mixing blade and surely mixed and agitated with the soil 36 behind the blade while avoiding the undesired effect of the soil pressure caused to the mixing blade rotating in the direction of the arrow. As shown in FIG. 20 through FIG. 23, various configurations of the guide plate 56 and the mixing blade 34 may be designed as required.

As described above, it is the fundamental feature of this invention to pneumatically transport cement or other powder stabilizing agent through the transportation tube 40 in the rotary shaft 32, jet out the powder from the nozzle 41 disposed to the base of the mixing blade 34 and then mix and agitate with the soil 36 so that they are uniformly solidificated, in which pneumatically transported cement powder of greater weight is scattered and remains within the soil while the air as the carrier gas of a smaller weight is separated therefrom and rises through the soil in the gap behind the mixing blade during rotation.

Figure 24:
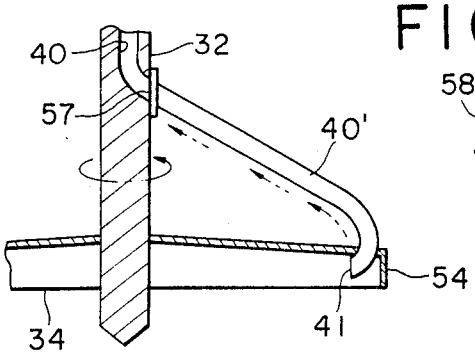
FIG. 24 is a side elevational view, partially in cross section, of another embodiment of a transportation tube combined to the mixing blade.

In the embodiment, shown in FIG. 24, the transportation tube 40 formed inside the rotary shaft 32 is branched at a bracket 57 situated above the mixing blade 34 as a transportation tube 40', the nozzle 41 of which is opened within the outer end of the mixing blade 34 and directed toward the base end of the rotary shaft 32. In this embodiment, the pneumatically transported cement agent jetted out from the nozzle 41 is scattered toward the interior through the gap at the back of the mixing blade 34 during rotation and the scattering amount is made unifrom over the entire rotating region of the mixing blade 34 even if the scattering amount is decreased toward the interior, since the rotational area is also decreased toward the inside, whereby the admixture and agitation with the soil 36 made uniform and the homogenous solidification can be attained over the area to be improved.

On the other hand, the carrier compressed air jetted out to the inner portion of the mixing blade 34 can be induced through the hollow portion formed at the back of the rotating branched transportation tube 40', and through the gap between the ground 1 and the rotary shaft 32 or the gap formed by the protruded guide 42 and discharged above the ground.

Figure 25:
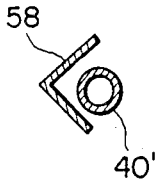
FIG. 25 is a cross sectional view of the branched transportation tube shown in FIG. 24.
Figure 26:
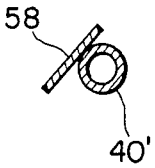
FIG. 26 is a cross sectional view, corresponding to FIG. 25, illustrating another embodiment of the transportation tube.

In this case, a soil pressure plate 58 against the soil 36 may be disposed in an adequate design form over the entire face in advance of the rotational direction of the transportation tube 40' so as to protect the tube 40' as shown in FIG. 25 and FIG. 26.

Figure 27:
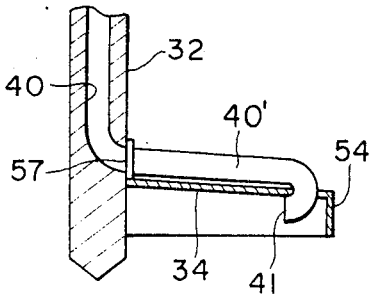
FIG. 27 is a side elevational view, partially in cross section, of a further embodiment of the transportation tube, corresponding to FIG. 24.
Figure 28:
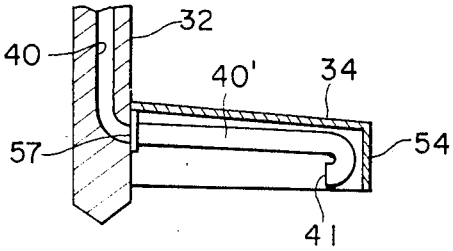
FIG. 28 is a side elevational view, partially in cross section, of a still further embodiment of the transportation tube, corresponding to FIG. 24.

Furthermore, in view of the strength required for the branched transportation tube 40 ' or for the by-pass of the separated rising air, the transportation tube 40' may be formed closer to the mixing blade 34 as shown in FIG. 27, or the nozzle 41 for the transportation tube 40 may be turned inwardly at the top end within the mixing blade 34 as in the embodiment shown in FIG. 28.

Figure 29:
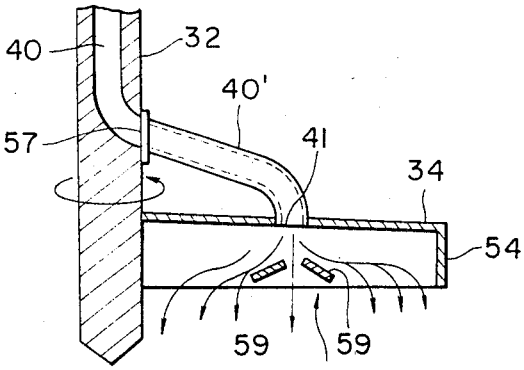
FIG. 29 is a side elevational view, partially in section, of a still further embodiment of the transportation tube, corresponding to FIG. 24.
Figure 30:
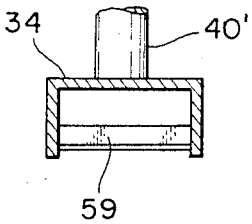
FIG. 30 is a transverse cross sectional view of the embodiment shown in FIG. 29.
Figure 32:
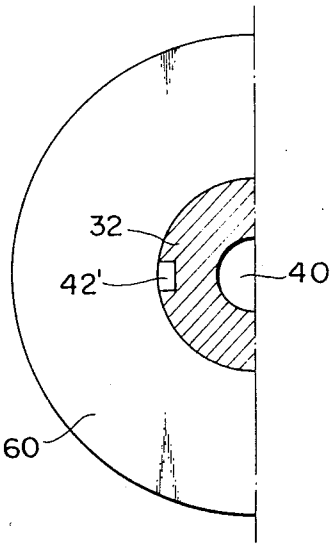
FIG. 32 is a transverse cross sectional view of one-half of the embodiment shown in FIG. 31.
Figure 31:
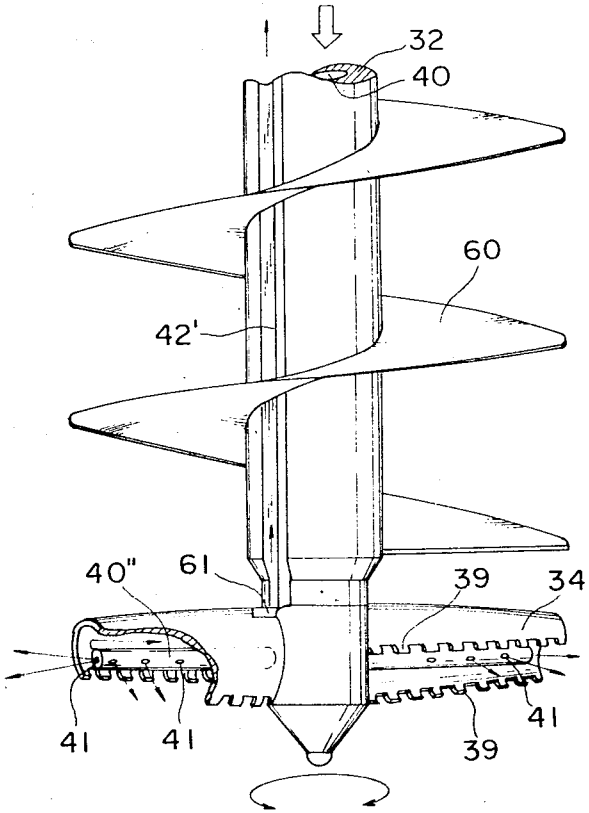
FIG. 31 is a partially cut-away perspective view of one embodiment of the rotary shaft equipped with a mixing blade and a screw auger.

Further, in the embodiment as shown in FIG. 29 and FIG. 30, the branched transportation tube 40' may be opened as a nozzle 41 to the upper surface at the mid portion of the mixing blade 34 and a pair of guide plates 59, 59 diverged outwardly may be disposed within the mixing blade 34 just below the nozzle 41 to uniformly distribute the pneumatically transported cement powder over the rotating region of the mixing blade 34 depending on the extent and the angle of the guide plates 59, 59.

In addition to the mixing blade 34 formed in each of the foregoing embodiments, a screw auger 60 may be disposed above the mixing blade 34 to the rotary shaft 32 in this invention. In the illustrated embodiment, a notch 42' as an exhaust guide is recessed at the circumference of the rotary shaft 32 and connected to a communication hole 61 formed at the base end of the mixing blade 34.

Further, in this embodiment, the transportation tube 40' as shown in FIG. 28 is extended outwardly within the mixing blade 34 and nozzles 41, 41 and each of different size are respectively at the outer end and along the side thereof, so that the cement powder is uniformly jetted out in the rotating range thereof upon rotation of the mixing blade 34 and uniformly mixed and agitated with the soil 36.

Accordingly, in this embodiment, mixing and agitation can be effected uniformly not only in the radial direction of the mixing blade 34 but also in the vertical direction by means of the screw auger through control of the rising and lowering speed of the rotary shaft 32, whereby the powdery cement agent and the soil 36 can be solidificated chemically with a higher homogenity.

In addition, according to this invention, a shaft hole with the same diameter as that for the mixing blade 34 is previously drilled in the ground 1 by an appropriate drilling or excavating device to primarily pulverize the soil 36 in the shaft hole and, thereafter, the rotary shaft 32 equipped with the mixing blade 34 is inserted downwardly and then extracted upwardly while pneumatically transporting cement powder and mixing and agitating with the soil 36 as described above. However, where the mixing blade 34 is being extracted upwardly after once having been positioned at the lowermost end in the column 35, since the guide at the top end of the rotary shaft 32 abuts the bottom of the shaft 35, there is a disadvantage in that the mixing and agitation of the pneumatically transported cement powder with the soil 36 can not be effected over a certain height from the bottom.

Figure 33:
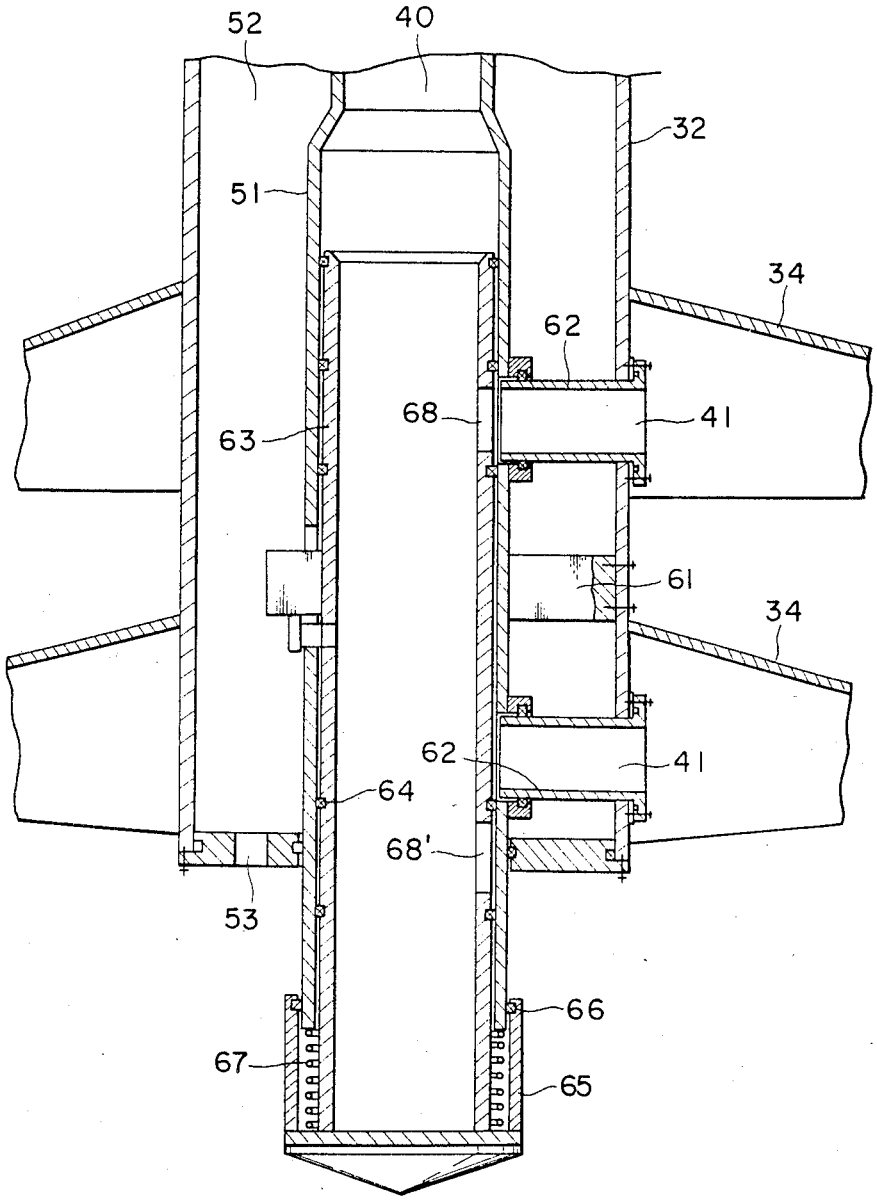
FIG. 33 is an explanatory view of the structure of a still further embodiment of the rotary shaft.

In order to overcome such disadvantage, in the embodiment illustrated in FIG. 33, an inner pipe 51 extends from the transportation tube 40 and is connected by means of a bracket 61 coaxially to the interior of the rotary shaft 32 so as to form an annular gap 52 in a manner similar to the embodiment shown in FIG. 9, and the inner pipe 51 is adapted to be in communication with the nozzles 41, 41 of the mixing blades 34, 34 disposed at two positions of different height near the top end of the rotary shaft 32 by way of pipes 62, 62 so that the carrier gas and the cement powder can be jetted out therethrough.

A sleeve pipe 63 is slidably disposed by way of a seal member 64 within the interior of the inner pipe 51 and the lower head 65 thereof is sealed by means of a seal member 66 to the outer side at the extreme end of the inner pipe 51 with a compression spring 67 being disposed vertically between the lower head 65 and the lower end of the inner pipe 51, so that the sleeve pipe 63 may be withdrawn relative to the interior of the inner pipe 51 during downward insertion of the rotary shaft 32 into the ground 1 by the soil pressure exerted against the head 65, where the nozzle 68' at the lower end is in communication with the nozzle 41 of the mixing blade 34 at the lower stage while the upper nozzle 68 may be interrupted from communication with the nozzle 41 of the mixing blade 34 at the upper stage.

Accordingly, during downward insertion of the rotary shaft 32 into the ground 1, compressed air is jetted out through the annular gap 52 between the inner pipe 51 and the rotary shaft 32 from the jetting port 53 to facilitate the insertion. Then, when the rotary shaft 32 reaches a predetermined depth, the cement powder is begun to be transported pneumatically. Since the spring 67 is still compressed by the soil pressure against the head 65, the lower nozzle 68' is in communication with the nozzle 41 of the mixing blade 34 at the lower stage and cement material is jetted out together with the air as the carrier gas into the soil 36 along with the rotation of the rotary shaft 32 and mixed and is agitated as described above.

When the rotary shaft 32 proceeds to the rising process at the next step, since the soil pressure against the sleeve pipe 63 is decreased, the sleeve pipe 63 is lowered relatively to the inner pipe 51 by the resiliency of the spring 67, where the communication between the lower nozzle 68' and the nozzle 41 of the mixing blade 34 at the lower stage is interrupted while the upper nozzle 68 is in communication with the nozzle 41 of the mixing blade 34 at the upper stage to jet out the cement powder within the mixing blade 34 at the upper stage and then mixed and agitated with the soil 36 in the same manner as in each of the foregoing embodiments. Accordingly, soil 36 in the previously drilled column 35 can be stabilized substantially over the entire depth according to this embodiment.

Furthermore, although the mixing blade 34 shown in each of the foregoing embodiments is of a fixed structure, if the energy of jetting out the pneumatically transported cement from the nozzle 41 is larger in relation with the soil 36, the cement material may be scattered further beyond the range of the fixed mixing blade 34.

In such a case it is desirable to make the mixing blade expansible and shrinkable for attaining the optimum mixing and agitation for the powdery cement.

Figure 34:
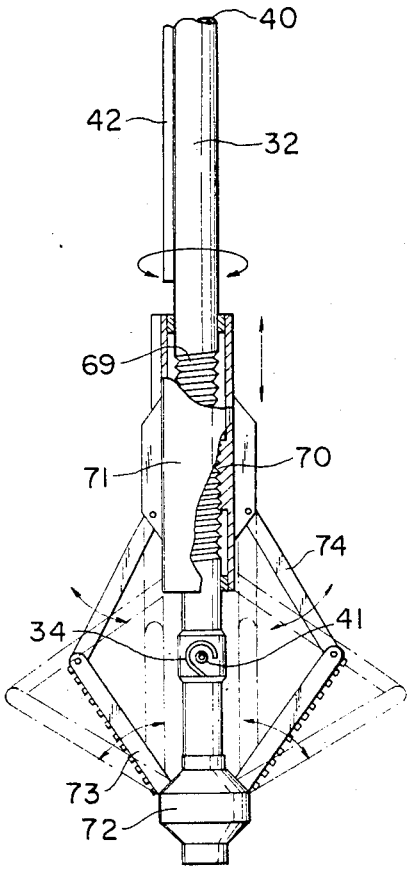
FIG. 34 is a partially cut-away side elevational view of another embodiment of the mixing blade secured to the rotary shaft.

Such an embodiment is illustrated in FIG. 34, wherein a sleeve 71 formed with female threads 70 is engaged with the rotary shaft 32 by means of male threads 69 formed around a predetermined position of the rotary shaft 32, and a bracket is rotatably disposed at the lowermost end of the rotary shaft 32. Then, mixing blades 73, 74 are hinged between the blaket 72 and the sleeve 71. In this embodiment, when the rotary shaft 32 is rotated in one direction upon insertion of the rotary shaft 32 into the ground 1, the sleeve 71 is moved upwardly to contract the lateral extension of the mixing blades 73, 74 by pulling them vertically, that is, to be brought in parallel with the rotary shaft 32. On the other hand, upon raising of the rotary shaft 32, the shaft 32 is rotated in the opposite direction to lower the sleeve 71 thereby expanding the mixing blades 73, 74 laterally so that the cement powder may be mixed efficiently with the soil 36 in cooperation with the mixing blade 34.

In this embodiment, the air as the carrier gas jetted out from the nozzle 41 can be exhausted along each of the mixing blades 73, 74 as the exhaust guide.

Figure 35:
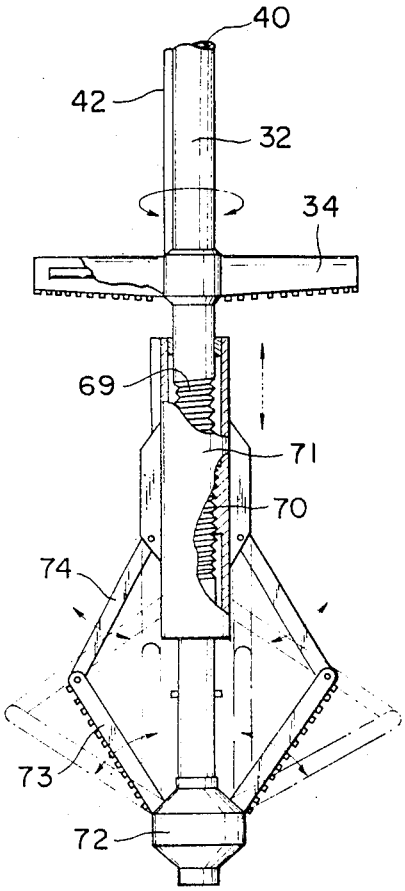
FIG. 35 is a partially cut-away side elevational view of a further embodiment of the mixing blade corresponding to FIG. 34.

While the sleeve 71 is disposed above the mixing blade 34 in this embodiment, the sleeve 71 may be disposed below the mixing blade 34 in another embodiment as illustrated in FIG. 35.

It will be apparent to those skilled in the art that the modes of practicing this invention are in no way limited only to the foregoing embodiments but various other embodiments are possible and are also within the scope of this invention. For instance, various kinds of powder stabilizing agent such as slug or quick lime may be employed in addition to the powdery cement.

According to this invention as described above, since cement or other powdery stabilizing agent is mixed and agitated with the soil in the soft ground without increasing the amount of underground water but rather absorbing the water content therein and reacting therewith to solidify, a fundamental advantage can be attained in that the soft ground can be stabilized surely and effectively while neither causing wasteful diffusion of injected material in the ground nor resulting in public pollution as experienced in the conventional chemical grouting injection method.

Further, since the powdery stabilizing agent jetted out into the ground and mixed and agitated with the soil is pneumatically transported on the air, the powdery stabilizing agent can be supplied smoothly to the inside of the ground.

Further, while the transportation tube formed to the inside of the rotary shaft is used for the supply of the powdery stabilizing agent into the ground, clogging or similar defects do not occur in this case because of the employment of the pneumatical transportation, which can eliminate troublesome maintenance or repair.

Further, since the air used as the transportation means escapes from the ground through the gap between the ground and the rotary shaft, such causes no gas bubbles within the ground and satisfactory solidification can be attained in the soil stabilization.

Further, since various powdery stabilizing agents such as slugs or the likes can be used in addition to the powdery cement, those powdery wastes that had to be treated so far by ocean disposal or could only be served for reclamation can now be utilized effectively, thus provide a sort of countermeasure for public pollutions.

Further, the carrier air released above the ground is separated and filtered from the cement or like other powdery stabilizing agent in the powder separation device equipped with the cyclone or the like and the air removed with the powdery stabilizing agent through filtration can be discharged in a cleaned state to the atmosphere, there is no risk of contaminating the working environment or resulting in public pollution to the residensual area in the neighbourhood.

Further, since the pneumatically transported cement or like other powdery stabilizing agent in the transportation tube of the rotary shaft is supplied by way of the swivel joint from an air pumping device connected to the constant volume discharger in the powder supply device, it can be supplied surely at a constant rate upon feeding of the powdery stabilizing agent on the ground and the soil stabilization can be carried out stably with no clogging.

Furthermore, since the control and administration are carried out for the entire system by the control device, the state of the pneumatically transported cement or other powdery stabilizing agent and the air as the transportation means therefor jetted out from the mixing blade formed integrally to the rotary shaft into the ground can be continously recorded and controlled to an optimum condition. Accordingly, the cement or other powdery stabilizing agent can be pneumatically transported and jetted out under the optimal condition at any depth of the mixing blade and the soil stabilization can always be attained reliably irrespective of the depth of the ground.

What is claimed is:

1. A method of soil stabilization by jetting the powdery stabilizing agent into the ground and mixing and agitating the same with the soil and utilizing compressed air, a transportation tube, a rotary shaft having a mixing blade integrally attached to and extending from a base of said shaft and a nozzle in communication with said blade, which comprises:

inserting a rotary shaft into the ground;

pneumatically feeding the powdery stabilizing agent from above the ground at a constant rate together with said compressed air by way of said transportation tube positioned within the rotary shaft;

jetting out the powdery stabilizing agent and the compressed air from said nozzle in communication with the mixing blade;

mixing and agitating the powdery stabilizing agent with the underground soil by rotation of the mixing blade to thereby solidifcate said agent and said soil;

inducing the carrier air jetted through the ground and then discharging the air outside the ground after filtration of said air; and controlling the supply of the powdery stabilizing agent in accordance with a predetermined condition.

2. The method of soil stabilization by jetting the powdery stabilizing agent into the ground as defined in claim 1, which further comprises supplying the powdery stabilizing agent with a constant volume and/or weight and transporting the powdery stabilizing agent pneumatically under the effect of the compressed air.

3. The method of soil stabilization by jetting the powdery stabilizing agent into the ground as defined in claim 1, which further comprises jetting the compressed air to a gap formed between the rotary shaft and the ground upon insertion of the rotary shaft into the ground.

4. The method of soil stabilization by jetting the powdery stabilizing agent into the ground as defined in claim 1, which further comprises dissipating the compressed air jetted in the ground through a gap between the rotary shaft and the ground to a location above the ground.

5. The method of soil stabilization by jetting the powdery stabilizing agent into the ground as defined in claim 4, which further comprises separating the compressed air so dissipated from the powdery stabilizing agent and then discharging said compressed air to the atmosphere.

6. An apparatus for soil stabilized by jetting powdery stabilizing aagent into the ground, comprising:

a powder supply device disposed on the ground and having a constant volume and/or weight discharge mechanism;

a rotary shaft having a transportation tube formed inside thereof, which is connected by means of a swivel joint to said constant volume and/or weight mechanism wherein, said rotary shaft further comprises a mixing blade disposed with a nozzle in communication with the transportation tube connected to the swivel joint and an exhaustion guide for inducing a carrier gas to outside of the ground, and a control device for controlling the operation of the constant volume and/or weight. discharge mechanism and the elevation of the rotary shaft.

7. The apparatus for soil stabilization by jetting the powdery stabilized agent into the ground as defined in claim 6, wherein the nozzle is disposed at a position with respect to the mixing blade at a position free from the effect of the soil pressure exerted against said blade in the rotational direction.

8. The apparatus for soil stabilization by jetting the powdery stabilized agent into the ground as defined in claim 6, wheren said mixing blade further comprises a mixing blade expansible and shrinkable by a predetermined stroke in a rotational direction thereof.

9. The apparatus for soil stabilization by jetting the powdery stabilized agent into the ground as defined in claim 6, wherein said rotary shaft further comprises an exhaust guide for the carrier gas formed along a cicumference thereof.

10. The apparatus for soil stabilization by jetting the powdery stabilized agent into the ground as defined in claim 6, wherein said powder separation device further comprises powder sucking means.

11. The apparatus for soil stabilization by jetting the powdery stabilized agent into the ground as defined in claim 6, further comprising an additional mixing blade and a radially expansible and shrinkable mechanism for connecting said additional mixing blade to said rotary shaft.

* * * * *